US006746027B1

(12) United States Patent
Soo

(10) Patent No.: US 6,746,027 B1
(45) Date of Patent: Jun. 8, 2004

(54) ADJUSTABLE SKATE HAVING A BLADDER

(76) Inventor: Mike Soo, No. 2, Lane 1102, Da-Wan Road, Yong-Kang Tainan Hsien (TW)

( * ) Notice: Subject to any disclaimer, the term of this patent is extended or adjusted under 35 U.S.C. 154(b) by 20 days.

(21) Appl. No.: 10/310,437

(22) Filed: Dec. 5, 2002

(51) Int. Cl.[7] ..... A63C 17/00; A63C 17/02; A43B 3/26; A43B 7/14; A43B 5/04

(52) U.S. Cl. ..... 280/11.26; 280/11.221; 280/11.19; 36/97; 36/93; 36/117.7

(58) Field of Search ..... 280/11.221, 11.225, 280/11.26, 11.16, 11.231; 36/97, 29, 93, 94, 72 R

(56) References Cited

U.S. PATENT DOCUMENTS 4,083,128 A * 4/1978 Rossman ..... 36/97
5,416,988 A * 5/1995 Potter et al. ..... 36/89
5,819,438 A * 10/1998 Wanniarachchi ..... 36/3 R
6,082,027 A * 7/2000 Wagonhurst ..... 36/97
6,217,039 B1 4/2001 Iverson et al.
6,588,771 B2 * 7/2003 Olson et al. ..... 280/11.221
6,655,050 B1 * 12/2003 Lowe ..... 36/93
2001/0054242 A1 * 12/2001 Miller, II ..... 36/127
2002/0035794 A1 * 3/2002 Doyle ..... 36/29

FOREIGN PATENT DOCUMENTS

TW 87208034 of 1999

* cited by examiner

*Primary Examiner*—Brian L. Johnson
*Assistant Examiner*—G B Klebe
(74) *Attorney, Agent, or Firm*—Alan Kamrath

(57) ABSTRACT

An adjustable skate includes a boot, a liner, and a bladder. The boot includes an upper and a sole, the upper having a toe cap and a heel portion. The liner is mounted in the boot and includes a bottom plate slidably mounted on the sole and a toe box on a front end of the bottom plate. A chamber for receiving a foot of a wearer's foot is defined between the toe box of the liner and the heel portion of the boot. The bladder is mounted between the toe box of the liner and the toe cap of the boot. The bladder has a volume that is adjustable through inflation of air into the bladder or discharge of air out of the bladder, thereby moving the liner along a lengthwise direction of the boot.

3 Claims, 5 Drawing Sheets

ADJUSTABLE SKATE HAVING A BLADDER

BACKGROUND OF THE INVENTION

1. Field of the Invention

The present invention relates to an adjustable skate having a bladder. In particular, the present invention relates to an adjustable skate having a bladder for adjusting a length of a chamber in the boot of the adjustable skate according to different foot lengths of different wearers.

2. Description of the Related Art

Skates, whether with wheels or a blade, are popular among young people. Many skates are adjustable in length and/or width to suit different foot sizes of various wearers. Nevertheless, the adjusting mechanisms of the skates are complicated and thus costly. Further, the adjusting procedures for the adjusting mechanisms are troublesome and time-consuming, as they include detachment of bolts and screws before adjustment as well as reassembling of the bolts and screws after adjustment. It is, therefore, a long and unfulfilled need in a simple adjusting device for the skates without time-consuming procedure for adjustment.

SUMMARY OF THE INVENTION

An object of the present invention is to provide an adjustable skate having a bladder for adjusting a length of a shoe chamber in the boot of the adjustable skate according to different foot lengths of different wearers.

An adjustable skate in accordance with the present invention includes a boot, a liner, and a bladder. The boot includes an upper and a sole, the upper having a toe cap and a heel portion. The liner is mounted in the boot and includes a bottom plate slidably mounted on the sole and a toe box on a front end of the bottom plate. A chamber for receiving a foot of a wearer's foot is defined between the toe box of the liner and the heel portion of the boot.

The bladder is mounted between the toe box of the liner and the toe cap of the boot. The bladder has a volume that is adjustable through inflation of air into the bladder or discharge of air out of the bladder, thereby moving the liner along a lengthwise direction of the boot.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
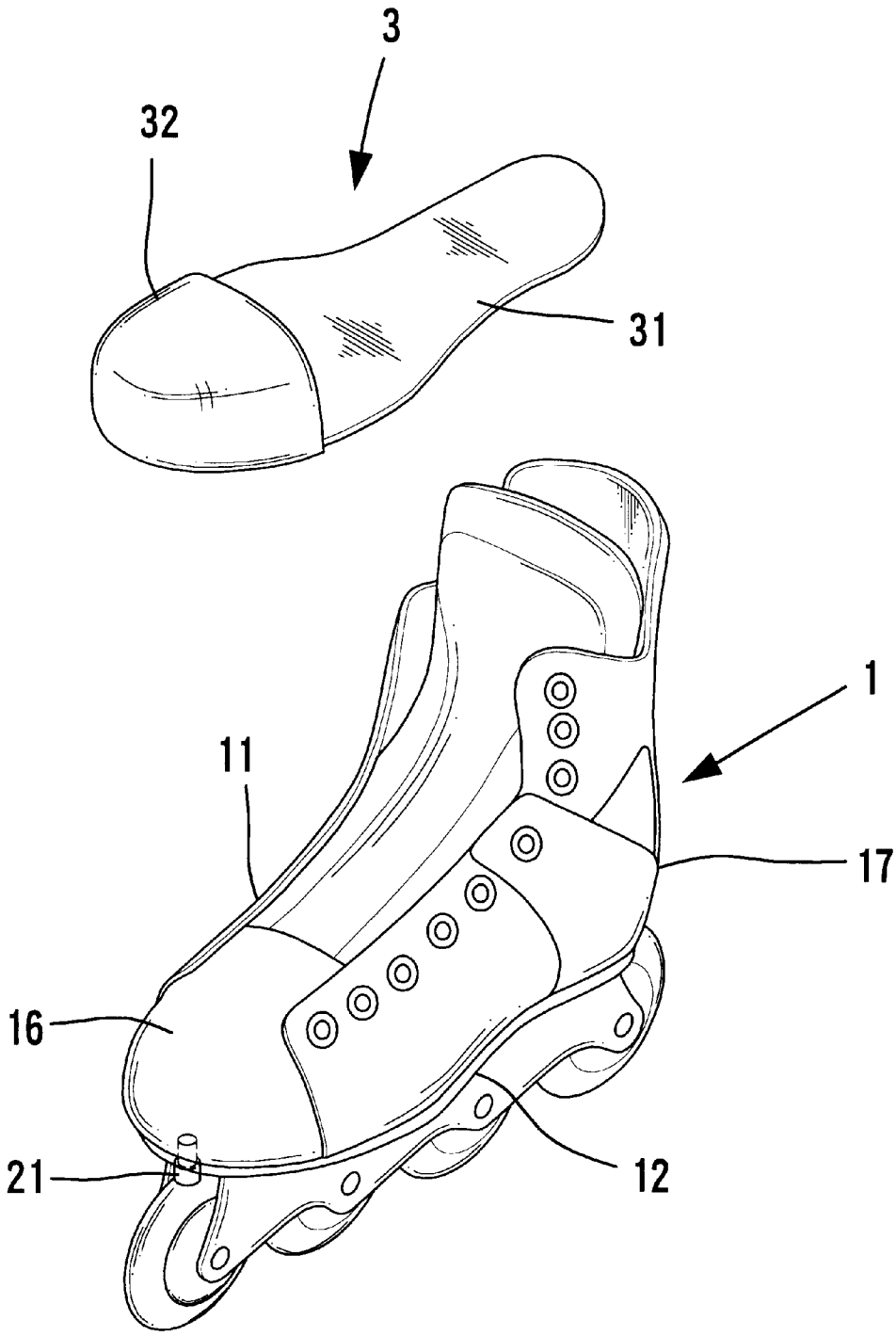
FIG. 1 is a perspective view, partly exploded, of an adjustable skate in accordance with the present invention.
Figure 2:
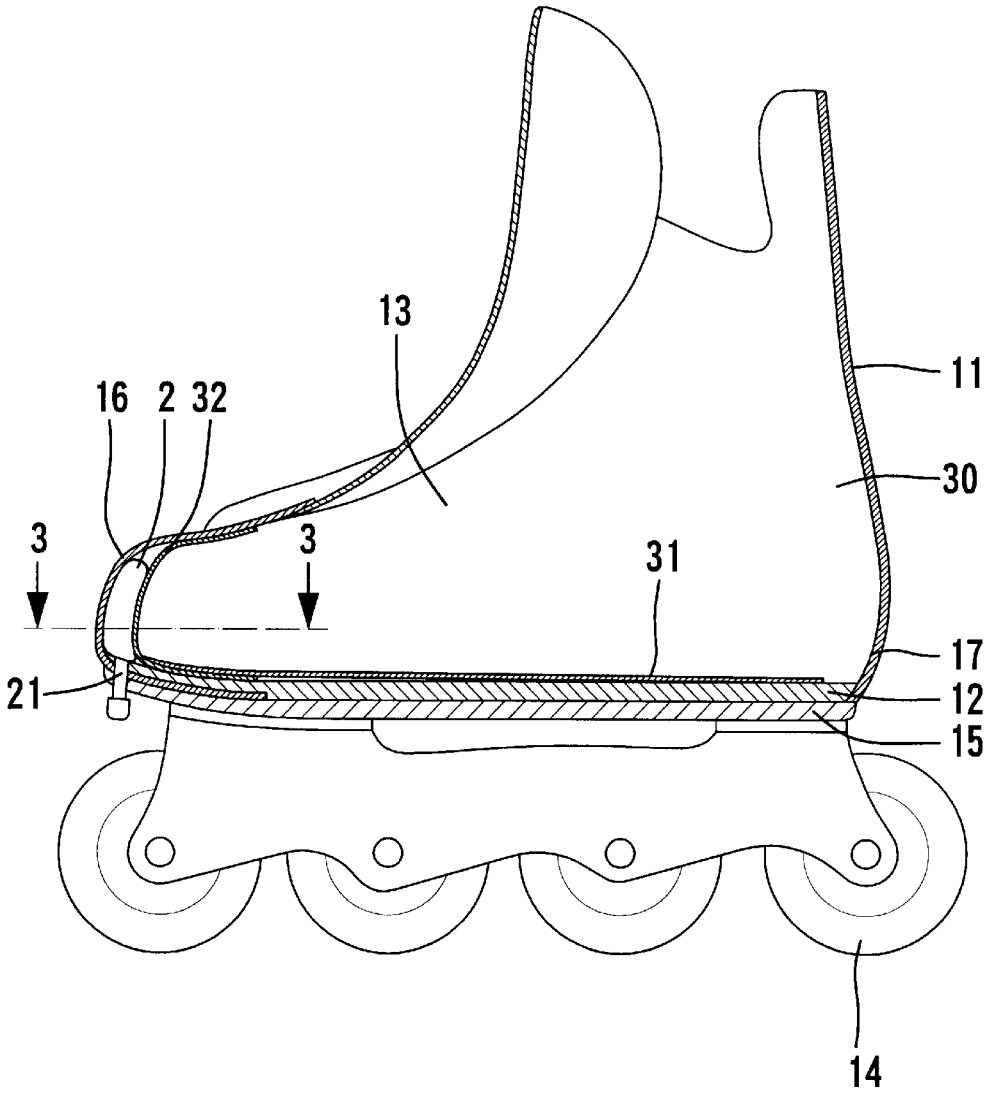
FIG. 2 is a side view, partly sectioned, of the adjustable skate in accordance with the present invention.
Figure 3:
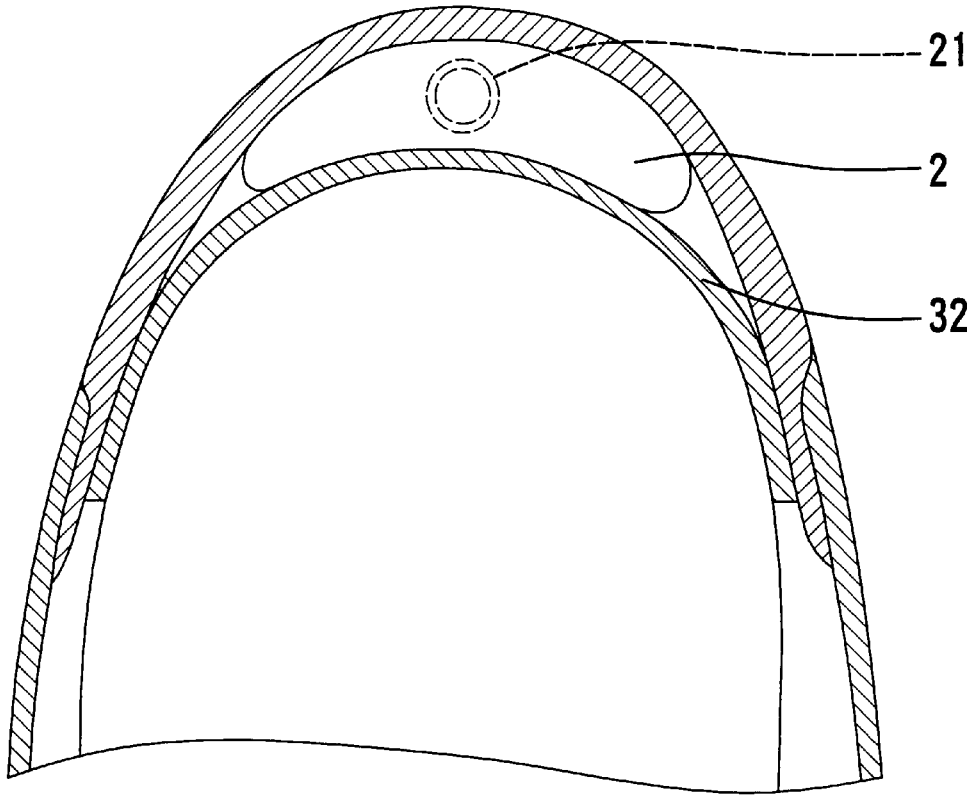
FIG. 3 is a sectional view taken along plane 3—3 in FIG. 2.

Referring to FIGS. 1 through 3, an adjustable skate in accordance with the present invention generally comprises a boot 1, a liner 3, and a bladder 2. The boot 1 includes an upper 11 and a sole 12 that are integrally molded from rigid plastics. The upper 11 includes a toe cap 16 and a heel portion 17 between which a compartment 13 is defined. Mounted below the sole 12 is a base 15 to which wheels or rollers 14 are attached. Of course, the rollers 14 can be replaced with a blade.

The liner 3 is made from rigid plastics and includes a bottom plate 31 on which a foot of a wearer stands. The liner 3 further includes a toe box 32 on a front end of the bottom plate 31. The toe box 32 is configured approximately the same as the toe cap 16, and the bottom plate 31 is slightly smaller than the sole 12. Thus, the liner 3 is slidable along a lengthwise direction of the boot 1. A chamber 30 is defined between the toe box 32 and the heel portion 17 of the boot 1 for receiving a foot of a wearer.

The bladder 2 is mounted in the boot 1 and located between the toe cap 16 of the boot 1 and the toe box 32 of the liner 3. In this embodiment, the bladder 2 includes an inlet 21 with a valve (not labeled) exposed outside the boot 1. Thus, air may be inflated into the bladder 2 or air in the bladder 2 may be discharged via the inlet 21. Thus, the overall volume of the bladder 2 is adjustable. The bladder 2 can be replaced with other equivalent designs.

Figure 4:
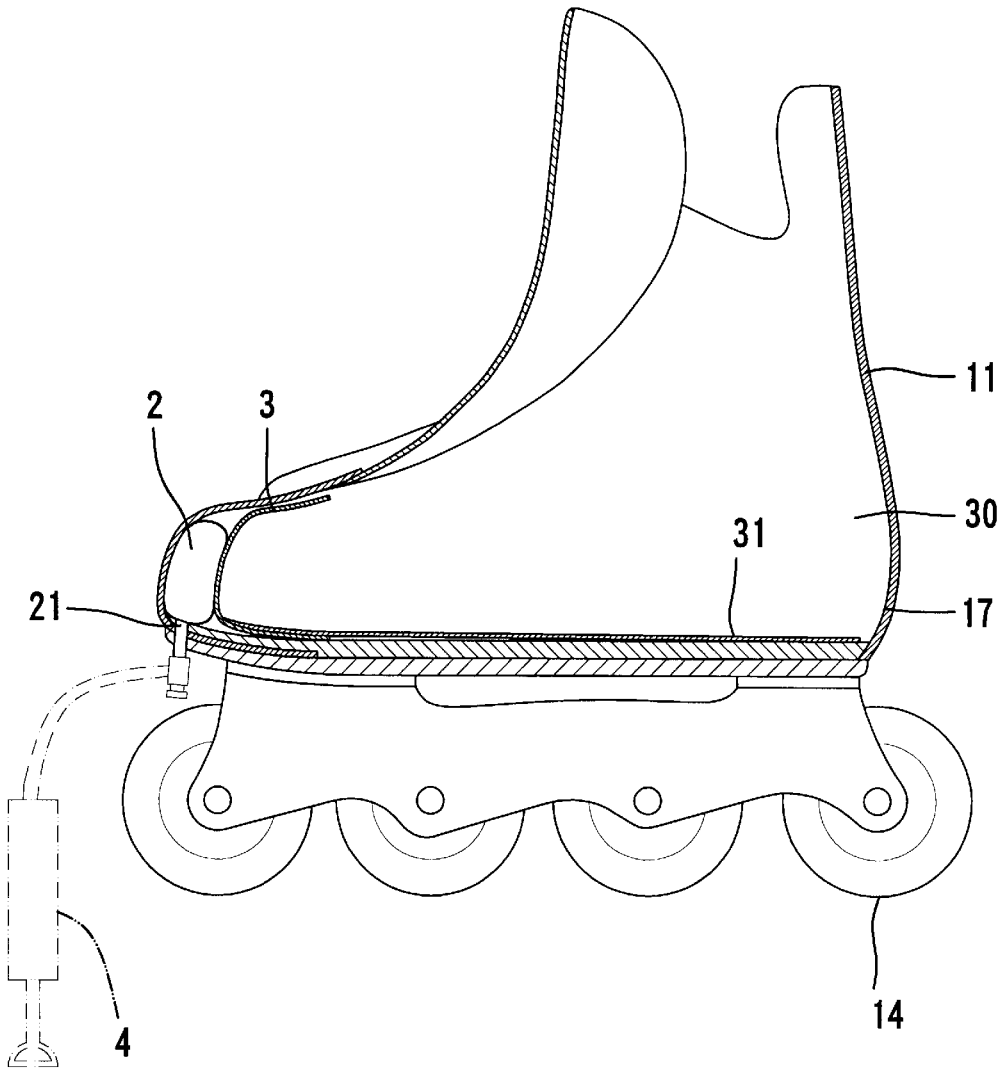
FIG. 4 is a view similar to FIG. 2, illustrating inflation of a bladder of the adjustable skate in accordance with the present invention.

In use, as illustrated in FIG. 4, if the wearer feels the chamber 30 is too large for his or her feet, the wearer may inflate air by an air pump 4 into the bladder 2 via the inlet 21, moving the liner 3 in the lengthwise direction of the boot 1. Thus, the overall length of the chamber 30 receiving the foot of the wear is reduced. On the other hand, if the wearer feels the chamber 30 is too small for his or her feet, air in the bladder 2 may be discharged to a desired extent, and the liner 3 is moved forward to the desired position. The adjusting procedure is significantly simplified when compared with conventional designs.

In addition to the adjustment responsive to the length of the foot of the wearer, the blade 2 provides a function of absorbing impact, thereby protecting the wearer's foot.

Figure 5:
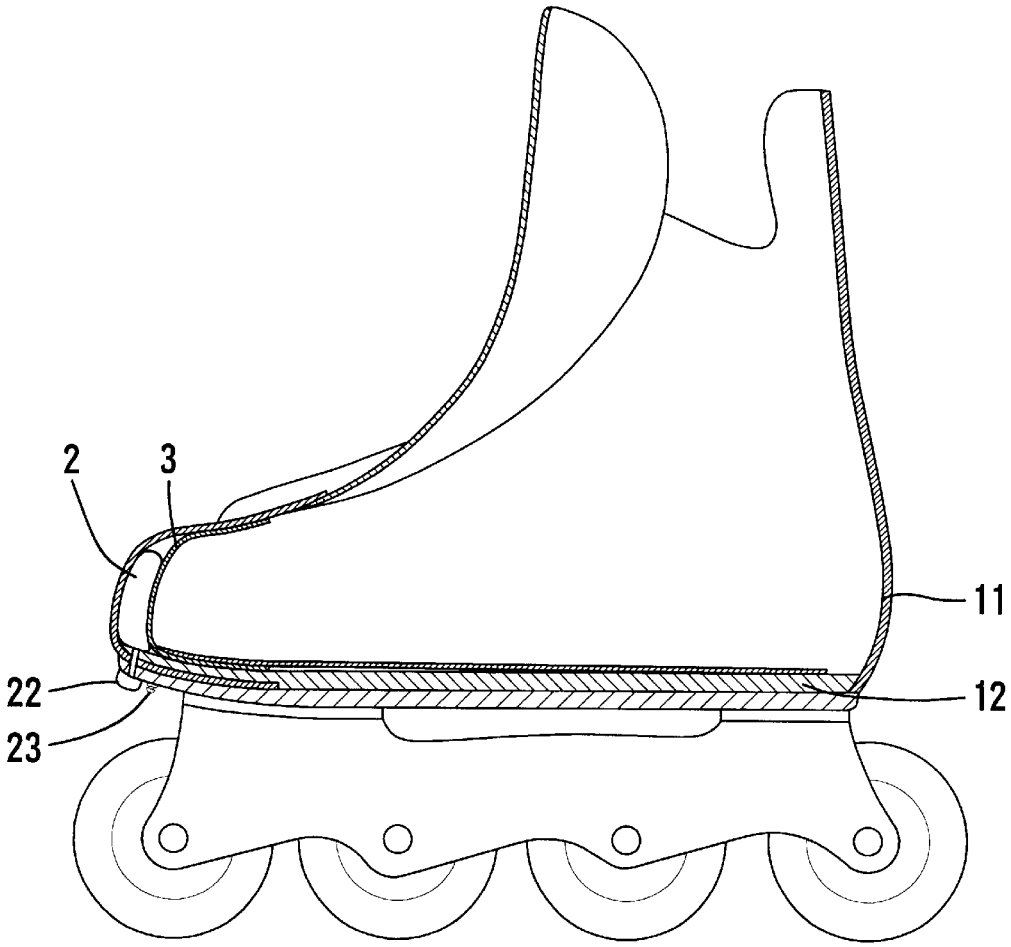
FIG. 5 is a view similar to FIG. 3, illustrating a modified embodiment of the adjustable skate in accordance with the present invention.

FIG. 5 illustrates a modified embodiment of the invention, wherein the bladder 2 includes a push button type valve 22 and a release valve 23 that are well know in the art. The function of the bladder 2 is not adversely affected.

Although the invention has been explained in relation to its preferred embodiments, it is to be understood that many other possible modifications and variations can be made without departing from the scope of the invention as hereinafter claimed.

What is claimed is:

1. An adjustable skate comprising:

a boot including an upper and a sole, the upper including a toe cap and a heel portion;

a liner mounted in the boot, the liner including a bottom plate slidably mounted on the sole and a toe box on a front end of the bottom plate, a chamber for receiving a foot of a wearer's foot being defined between the toe box of the liner and the heel portion of the boot; and a bladder mounted between the toe box of the liner and the toe cap of the boot, the bladder having a volume that is adjustable through inflation of air into the bladder or discharge of air out of the bladder, thereby moving the liner along a lengthwise direction of the boot.

2. The adjustable skate as claimed in claim 1, wherein the bladder includes an inlet with a valve exposed outside the boot.

3. The adjustable skate as claimed in claim 1, wherein the liner is made of rigid plastics.

* * * * *